United States Patent [19]

Sugawara et al.

[11] Patent Number: 4,576,492

[45] Date of Patent: Mar. 18, 1986

[54] MULTI-STAGE PRINTER

[75] Inventors: Fukuo Sugawara, Yokohama; Yasuhiko Iwane, Morioka; Fumihisa Hori; Takashi Onozato, both of Tamayama, all of Japan

[73] Assignee: Alps Electric Co., Ltd., Japan

[21] Appl. No.: 554,604

[22] Filed: Nov. 23, 1983

[30] Foreign Application Priority Data

Nov. 24, 1982 [JP] Japan ..... 57-204531

[51] Int. Cl.[4] ..... B41J 9/12; B41J 11/36; B41J 19/76; B41J 27/08

[52] U.S. Cl. ..... 400/146; 400/620; 400/551; 400/159; 400/157.2; 101/93.11; 101/93.13

[58] Field of Search ..... 400/650, 551, 146, 159, 400/157.1, 157.2; 101/93.11–93.15

[56] References Cited

U.S. PATENT DOCUMENTS

| | | | |
|---|---|---|---|
| 2,318,000 | 5/1943 | Lippert | 400/551 |
| 3,217,855 | 11/1965 | Heberkorn et al. | 400/620 |
| 3,749,221 | 7/1973 | Busch | 400/620 |
| 3,844,395 | 10/1974 | Mero et al. | 400/620 |
| 4,224,869 | 9/1980 | Morin | 400/551 |
| 4,250,807 | 2/1981 | Kondo et al. | 101/93.09 |
| 4,443,123 | 4/1984 | Ono et al. | 400/146 |

FOREIGN PATENT DOCUMENTS

| | | | |
|---|---|---|---|
| 878225 | 9/1961 | United Kingdom | 400/620 |

OTHER PUBLICATIONS

Pennebaker et al., "Duplex Printing . . . " IBM Technical Disclosure Bulletin, vol. 24, No. 4, pp. 2017–2018, 9/81.

Parlson "Automatic Platen Indexing System" IBM Technical Disclosure Bulletin, vol. 18, No. 10, p. 3352, 3/76.

*Primary Examiner*—William Pieprz

*Attorney, Agent, or Firm*—Guy W. Shoup

[57] ABSTRACT

A multi-stage printer has an arithmetic section for calculating the next paper moving amount on the basis of a line position of a selected type stage of a plurality of type stages; printing is performed by a desired number of digits in a first line position by using first types selected from the groups of types; then, the distance from the printed first line position to a printed state-confirmable position away from the area opposed to the groups of types is calculated by the arithmetic section and the printing paper is moved by the paper moving means by an amount based on the result of the calculation thereby allowing the printed first line position to be moved up to the confirmable position; then, before printing in a second line position by using second types selected from the groups of types, the distance from the printed first line position now occupying the confirmable position to the second selected types is subtracted from a predetermined printing inter-line pitch in the arithmetic section and the printing paper is moved by the paper moving means by an amount based on the result of the calculation, thereafter printing is performed in the second line position by using the second types.

9 Claims, 26 Drawing Figures

MULTI-STAGE PRINTER

BACKGROUND OF THE INVENTION (1) Field of the Invention

The present invention relates to a multi-stage printer in which, for example, endless type belts are disposed in plural stages. Particularly, it is concerned with an adjustment of the pitch between lines.

(2) Description of the Prior Art

Recently, electronic calculators have been showing a tendency to have a larger number of functions and become more sophisticated and at the same time have been reduced in both size and weight, and it has been desired that electronic calculators with a printer capable of preserving calculation results as printed data be also reduced in both size and weight. As printers contained in electronic devices of this type for general domestic use, matrix printing type a printers are desired because a machine glazed paper comprising an easily available and inexpensive ordinary paper can be used and further because printed data are clear; in addition, it is also desired that the number of driving elements be as small as possible and that the price be low.

To meet such demands, studies have been made about a multi-stage printer in which endless type belts are disposed in plural stages.

FIG. 1 is a schematic block diagram of this type of a printer, in which a driving pulley 1 and a driven pulley 2 are disposed at a predetermined spacing, with later-described endless type belts 3 and 4 being stretched in two stages therebetween. A worm 6 is mounted on a rotating shaft of a single DC motor 5 which serves as a driving source. The driving force of the DC motor 5 is transmitted to a main gear 9 via a first idle gear 7 and a second idle gear 8. The rotating force from the main gear 9 is transmitted to the driving pulley 1 via a spring clutch (not shown). Further, a printing/carry gear 10 is engageable with the main gear 9.

To the printing/carry gear 10 is connected one end of a shaft 11. The shaft 11 is disposed between the driving pulley 1 and the driven pulley 2 and extends in parallel with the type belts 3 and 4. A hammer holder 12 which contains a hammer is mounted on the shaft 11 so as to be axially slidable. On the other hand, a guide plate 13 is disposed outside the type belts 3 and 4, and a paper 14, which is disposed between the guide plate 13 and the type belts 3 and 4, is guided and fed to the vicinity of the outside of the type belts 3 and 4 by paper feed means (not shown). The numeral 15 denotes a position detector disposed in the vicinity of the driven pulley 2 to detect a reference position for the selection of type and a type position. The numeral 16 denotes an ink roller for applying ink onto type surfaces formed on the outer peripheries of the type belts 3 and 4.

The type belts 3 and 4 are endless as shown in FIG. 2, and on the outer periphery of the upper type belt 3 are disposed types 17 circumferentially in large numbers and at predetermined pitches, the types 17 being in the form of numerals such as "0", "1", "2", etc. and other symbols such as "×", "÷", "−", "+", " ", etc., while also on the outer periphery of the lower type belt 4 there are disposed types 18 of the same arrangement as the upper types 17 circumferentially in large numbers and at predetermined pitches. The type belts 3 and 4, which are formed of, for example, a synthetic rubber or a synthetic resin of a low polymerization degree, have suitable flexibility and elasticity as the entire type belt.

The ink roller 16, as shown in FIG. 3, comprises as upper sponge member 19*a* impregnated with black ink, a lower sponge member 19*b* impregnated with red ink, and a cover 20 for both sponge members 19*a* and 19*b*. The upper and lower sponge members 19*a* and 19*b* are urged elastically toward the type belts 3 and 4 so that they are brought into contact respectively with the types 17 on the upper type belt 3 and the types 18 on the lower type belt 4. Consequently, at all times, black ink is applied to the types 17 on the upper type belt 3, while red ink is applied to the types 18 on the lower type belt 4.

Printing operation will now be described. The DC motor 5 rotates in accordance with a print start signal and this rotating force is transmitted to the driving pulley 1 via first idle gear 7, second idle gear 8 and main gear 9 to rotate the type belts 3 and 4 in the direction of arrow A in FIG. 1, and it is here assumed that the position detector 15 has detected the reference position. At this time, the amount of movement from the type (assumed to be numeral "0") opposed to a hammer 21 up to the type (assumed to be numeral "3") to be printed is calculated in a control section (not shown), and the amount of movement of the type belts 3 and 4 is counted by the position detector 15. When the type having the numeral "3" is opposed to the hammer 21, the power transmission from the DC motor 5 to the driving pulley 1 is cut off by operation of a clutch and the numeral "3" is printed.

FIG. 4 is a view for explaining this printing operation, which shows a state before printing. In this state, the hammer 21 is pulled backward by means of a tension spring 22 and is positioned by a stopper (not shown). The shaft 11 rotates once in the direction of arrow B in FIG. 4 by virtue of the driving force transmitted from the main gear 9. In this case, in a forward semi-circular rotation, a hammer driver 23 abuts a receiving portion 24*a* of a hammer pressing member 24, and the subsequent rotation of the hammer driver 23 causes the hammer pressing member 24 to be pushed out forward against the resilience of the tension spring 22. As a result, the numeric type "3" which has been selected as previously described and now opposed to the paper 14 is pushed forward by thrusting out of the hammer pressing member 24 and hammer 21 whereby the desired print of "3" is attained. In a backward semi-circular rotation of the shaft 11, there is performed a carry operation (not shown).

As previously noted, black ink is applied to the types 17 on the upper type belt 3, while red ink is applied to the types 18 on the lower type belt 4, therefore, the color of printed numerals, etc. can be changed between black and red by changing the type belt to be opposed to the hammer 21 between the upper and lower type belts 3 and 4. This will be described below with reference to a shift mechanism shown in FIGS. 5 and 6.

FIG. 5 shows a state in which a black type is to be printed by using the upper type belt 3. The hammer 21 is in abutment with one end of an L-shaped cam 26 which is pivotable about a fulcrum 25, and it is urged in the direction of contact with the L-shaped cam 26 at all times by suitable biasing means (not shown). The L-shaped cam 26 has an abutting portion 26*a* with the hammer 21, the abutting portion 26*a* being in an elongated shape which covers the entire transfer area for the hammer 26. The numeral 27 denotes an electromagnetic solenoid, and the fore end of an actuator 28 of the solenoid 27 is pivoted to the other end of the L-shaped cam 26. The numeral 29 denotes a return spring for biasing the L-shaped cam 26 in a counterclockwise direction.

In the state shown in FIG. 5, since the solenoid 27 is not energized, the hammer 21 is opposed to a type 17. Therefore, if, for example, the numeral "1" is selected from among the upper types 17, a black "1" is printed in the lowest digit position on the paper 14 by the foregoing printing operation of the hammer 21. Thereafter, carry of the hammer 21 is performed and a desired type is selected and hammered in the same way for printing in the next digit position. By repeating this operation, printing of one line is completed.

In case, for example, a red numeral "3" is to be printed in the lowest digit position on the next line, the type belts 3 and 4 are moved by an appropriate distance by the foregoing calculation process and the numeral "3" on the upper type belt 3 occupies the position opposed to the hammer 21. If in this state the hammer 21 is pushed by the hammer pressing member 24, a black numeral "3" will be printed. To avoid this inconvenience, the solenoid 27 is energized in accordance with a command from the control section, whereby, as shown in FIG. 6, the actuator 28 is attracted by the solenoid 27 and thereby rotated in a counterclockwise direction, so that the L -shaped cam 26 rotates in a clockwise direction. Consequently, the hammer 21 goes down because a downward biasing force is imparted thereto, and comes into an opposed relation to the lower type belt 4 as shown in FIG. 6. In this state, therefore, if the hammer 21 is pushed against the type belt 4 by the hammer pressing member 24 in the same way as in the foregoing printing operation, a red numeral "3" is printed on the paper 14. By continuing the printing operation in this shifted state to the lower stage of the hammer 21, printing data of one line are printed in red color. In case black printing data are to be printed on the line next the red printing data, paper is advanced by two lines and the foregoing operation is repeated.

FIGS. 7(*a*), (*b*), (*c*) and (*d*) are illustrative of paper moving and printing operations in a conventional printer of this type. First, for example, the upper type belt 3 is selected as shown in FIG. 7(*a*) and printing is performed therethrough by a predetermined number of digits on the paper 14, then after completion of printing on that line, a paper moving roller (not shown) is rotated to advance that first printed position 30 above the upper type belt 3 as shown in FIG. 7(*b*) and thus the paper 14 is moved up to a position (confirming position) where the printed state can be confirmed with the eyes 31 of the printer operator.

Then, according to such conventional printer, in both the case where the next line is to be printed also with the upper type belt 3 as shown in FIG. 7(*c*) and the case where it is to be printed with the lower type belt 4 as shown in FIG. 7(*d*), printing is performed while leaving the paper 14 intact, that is, without making adjustment of the pitch between lines. Consequently, in the case of printing with the upper type belt 3, the inter-line pitch P between the first printed position 30 and a second printed position 32 is smaller than that in the case of printing with the lower type belt 4. This irregularity of the inter-line pitch P occurs at every switching between the type belts 3 and 4, thus making it difficult to see the printed state as is apparent also from FIG. 8.

SUMMARY OF THE INVENTION

It is the object of the present invention to provide a printer capable of eliminating the above-mentioned drawbacks of the prior art and presenting a good printed state.

This object can be attained by a multi-stage printer according to the present invention having a printing paper adapted to be moved in predetermined directions, means for moving the printing paper, groups of types disposed in plural stages along the moving directions of the printing paper, and hammer means movable along the direction of arrangement of the groups of types for pushing out one type selected from the groups of types to effect a desired printing, characterized by a construction such that an arithmetic section for calculating the next paper moving amount on the basis of a line position of selected types is provided; printing is performed by a desired number of digits in a first line position by using first types selected from the groups of types; then, the distance from the printed first line position to a printed state-confirmable position away from the area opposed to the groups of types is calculated by the arithmetic section and the printing paper is moved by the paper moving means by an amount based on the result of such calculation thereby allowing the printed first line position to be moved up to the confirmable position; then, before printing in a second line position by using second types selected from the groups of types, the distance from the printed first line position now occupying the confirmable position to the second selected types is subtracted from a predetermined printing inter-line pitch in the arithmetic section and the printing paper is moved by the paper moving means by an amount based on the result of the calculation, thereafter printing is performed in the second line position by using the second types.

DESCRIPTION OF PREFERRED EMBODIMENTS

Figure 1:
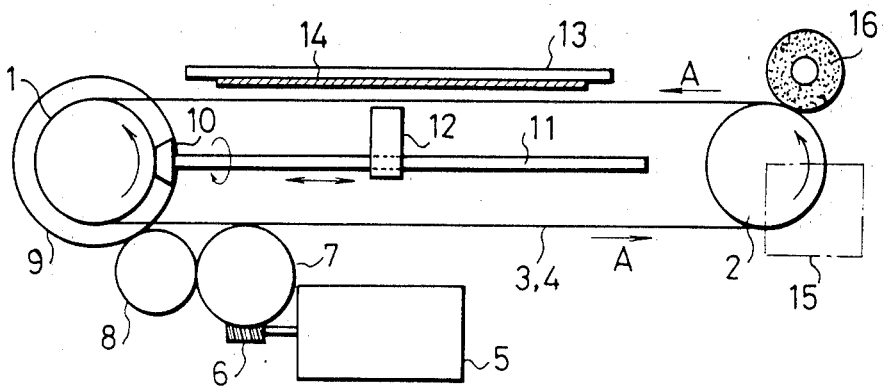
FIG. 1 is a schematic block diagram in plan view of a printer.
Figure 2:
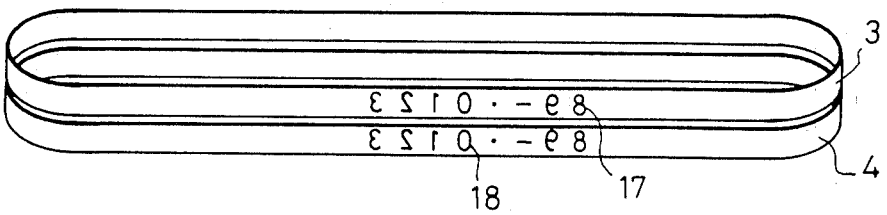
FIG. 2 is a perspective view of type belts.
Figure 3:
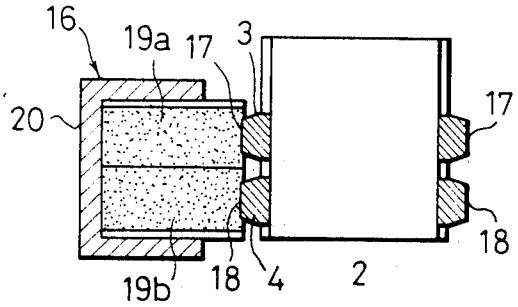
FIG. 3 is a partially sectional view showing the relation between an ink roller and the type belts.
Figure 4:
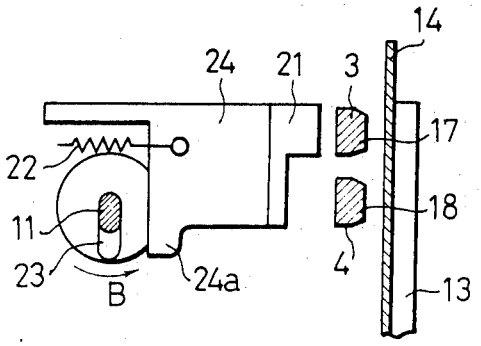
FIG. 4 is a side view illustrative of a printing operation.
Figure 5:
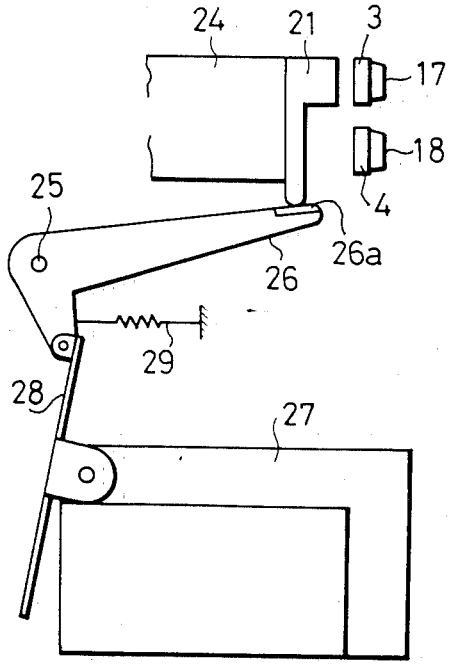
FIGS. 5 and 6 are explanatory views showing a shift mechanism for moving a hammer vertically.
Figure 6:
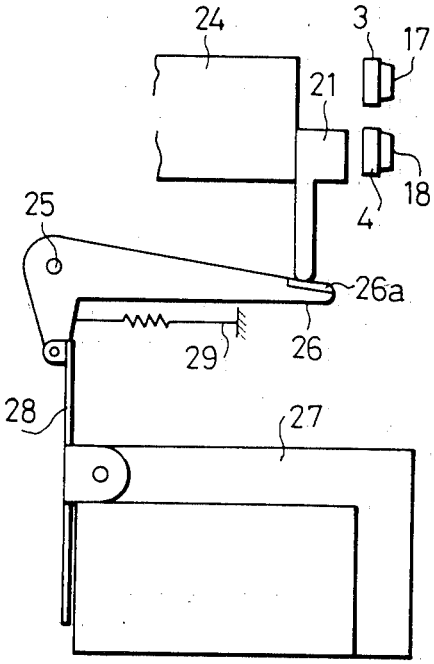
Figure 7A:
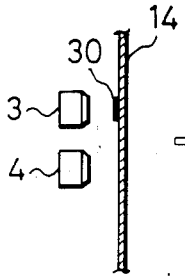
PRIOR ART Fig. 7(a)
FIGS. 7(*a*), (*b*), (*c*) and (*d*) are explanatory views illustrative of paper advancing and printing operations in a conventional printer.
Figure 7B:
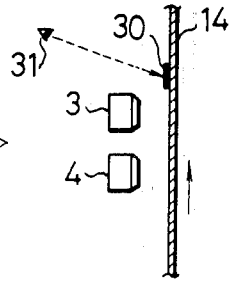
PRIOR ART Fig. 7(b)
Figure 7C:
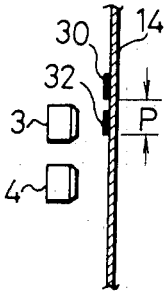
PRIOR ART Fig. 7(c)
Figure 7D:
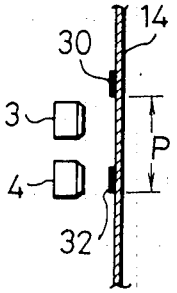
Fig. 7(d) PRIOR ART
Figure 8:
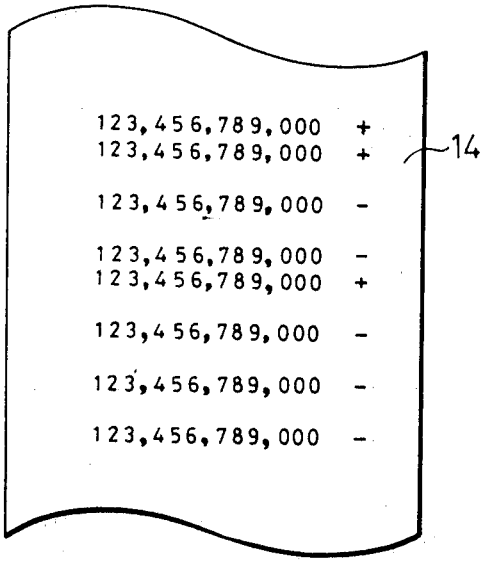
Fig. 8 PRIOR ART
FIG. 8 is a plan view of a paper printed by such printer.
Figure 9:
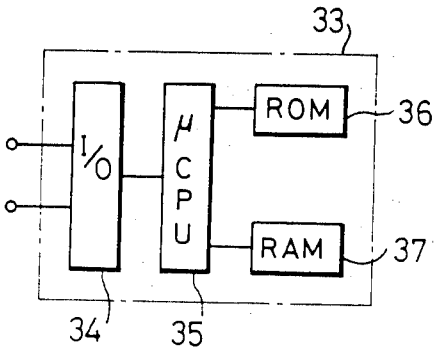
FIG. 9 is a schematic block diagram of a control section of a printer according to a first embodiment of the present invention.
Figures 10A, 10B, 10C:
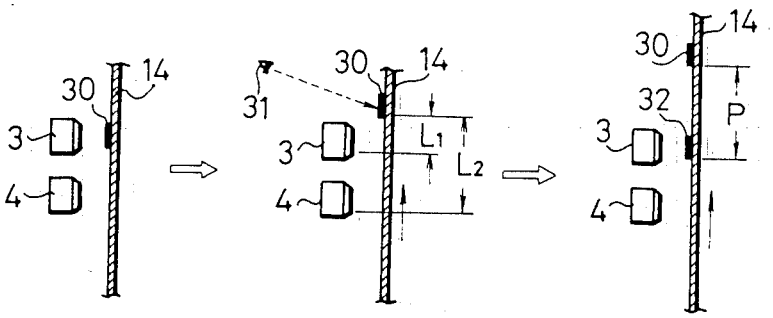
FIGS. 10(*a*), (*b*), (*c*), (*d*) and FIGS. 11(*a*), (*b*), (*c*), (*d*) are explanatory views illustrative of the adjustment of an inter-line pitch in the printer of the invention.
Figure 10D:
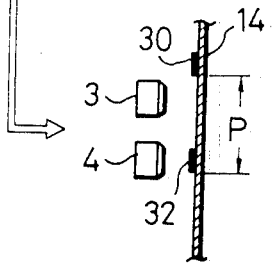
Figures 11A, 11B, 11C:
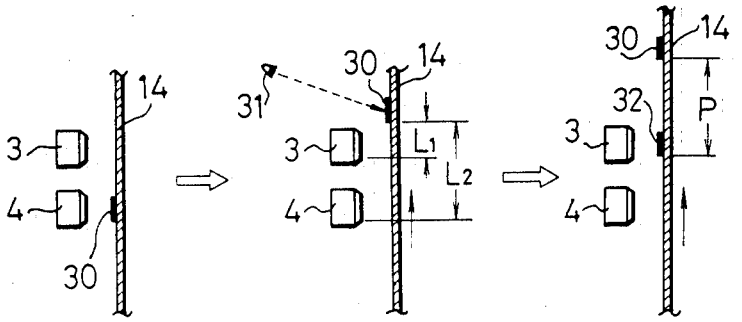
Figure 11D:
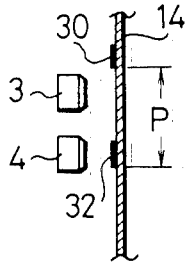
Figure 12:
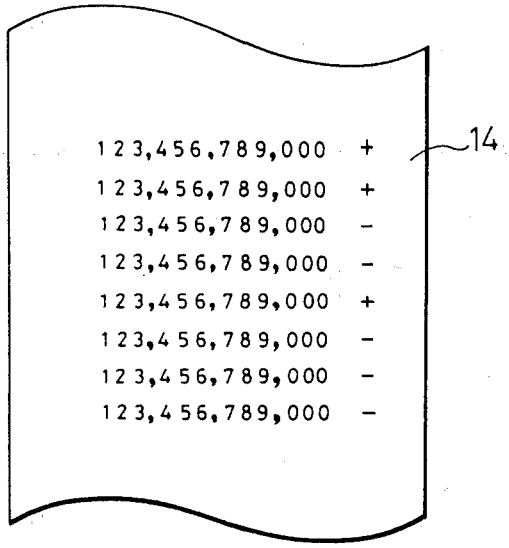
FIG. 12 is a plan view of a paper printed by the printer of the invention.
Figure 13A:
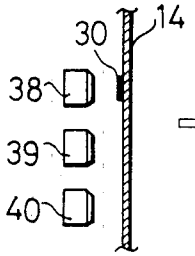
FIGS. 13(*a*), (*b*), (*c*), (*d*) and (*e*) are explanatory views illustrative of the adjustment of an inter-line pitch in a printer according to a second embodiment of the present invention.
Figure 13B:
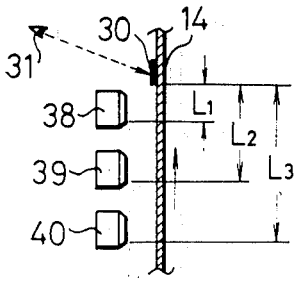
Figure 13C:
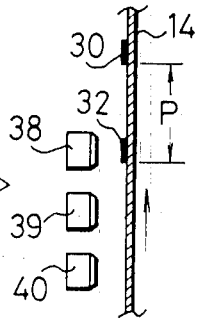
Figure 13D:
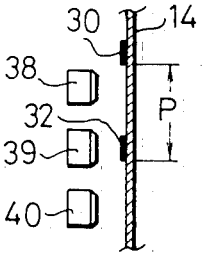
Figure 13E:
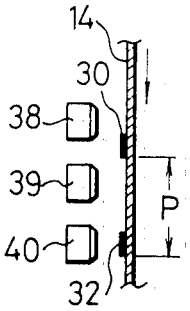

Embodiments of the present invention will now be described with reference to the accompanying drawings. FIGS. 9 through 12 are explanatory views illustrative of a printer according to a first embodiment of the invention, in which FIG. 9 is a schematic block diagram of a control section contained in the printer, FIGS. 10 and 11 are explanatory views illustrative of paper moving and printing operations of the printer, and FIG. 12 is a plan view of a paper printed by the printer.

A control section 33 contained in the printer is composed principally of an input/output interface (I/O) 34, a central processing unit (μCPU) 35, a read-only memory (ROM) 36 and a random access memory (RAM) 37. In the ROM 36 are pre-stored control-related programs, etc. in the operations of the printer.

The inter-line pitch adjusting operation will now be explained with reference to FIGS. 10 and 11. Reference is here made first to the inter-line pitch adjusting pattern shown in FIG. 10. As shown in FIG. 10(*a*), first the upper type belt 3 is selected and, for example, a black printing is performed by a predetermined number of digits on the paper 14. After completion of printing on that line, a paper moving roller (not shown) is rotated to advance the first printed line position 30 above the upper type belt 3 as shown in FIG. 10(*b*), that is, the paper 14 is moved up to a position (confirmable position) where the printer operator can confirm the printed state with his own eyes 31.

Which type belt has been selected (the upper type belt 3 in the case of this example) is stored in the RAM 37 through the input/output interface 34 in accordance with a type belt selection command signal. On the other hand, in the ROM 36 are prestored the distance from the upper printing position to the confirmable position in the case of selection of the upper type belt 3, that is, the paper advancing amount in upper type belt selection, as well as the distance from the lower printing position to the confirmable position in the case of selection of the lower type belt 4, that is, the paper advancing amount in lower type belt selection.

Either the paper advancing amount in upper type belt selection or that in lower type belt selection stored in the ROM 36 is accessed in accordance with the type belt selection signal stored in the RAM 37, and the angle of rotation of the paper moving roller is calculated on the basis of the accessed paper advancing amount. In case the lower type belt 4 is selected and printing performed, the angle of rotation of the paper moving roller becomes larger inevitably because the distance from the printing position up to the confirmable position is longer than that in the case where the upper type belt 3 is selected. The paper moving roller is rotated on the basis of the above calculated angle of rotation thereof, whereby the paper 14 is advanced. An encoder is attached to the paper advancing roller to thereby control accurately the angle of rotation of the paper moving roller, in other words, the moving amount of the paper 14.

In case the next line is to be printed, for example, in black color as shown in FIG. 10(*c*), the upper type belt 3 is selected and printing performed, which, however, is preceded by a paper moving operation for adjustment of the pitch between lines. More particularly, an inter-line pitch P from the previously printed first line position to the second printed line position 32 is predetermined. And, as shown in FIG. 10(*b*), the distance $L_1$ from the first printed line position 30 occupying the confirmable position to the type belt selected for printing the next line, i.e. the upper type belt 3, is subtracted from the inter-line pitch P by the μCPU 35 in the control section 33. Then, the paper moving roller is rotated by an amount based on the result of the calculation to move the paper 14 upward, and thereafter printing is performed by using the upper type belt 3 [see FIG. 10(*c*)]. By so doing, the pitch between the first and second printed line positions 30 and 32 becomes corresponding to the predetermined inter-line pitch P. Then, the paper advancing operation is again performed to move the printed line position 32 up to the confirmable position.

In case the next line is to be printed in a different color, for example, in red after confirmation of the first printed line position as shown in FIG. 10(*b*), the lower type belt 4 is in turn selected and, as shown in FIG. 10(*b*), the distance $L_2$ from the first printed line position 30 which occupies the confirmable position to the type belt selected for printing the next line is subtracted from the inter-line pitch by the μCPU 35 in the control section 33. The confirmable position and the position of the lower type belt 4 are so positioned as $L_2=P$ in this embodiment, so $P-L_2=0$ and therefore the paper is not advanced and a desired type is printed by using the lower type belt 4 in its present position as shown in FIG. 10(*d*). By so doing, the printing time is shortened and the pitch between the first and second printed line positions 30 and 32 becomes corresponding to the predetermined inter-line pitch P. Then, the paper advancing operation is performed whereby the printed line position 32 is moved up to the confirmable position.

In case the distance $L_2$ is so designed as to be $L_2<P$, the predetermined inter-line pitch P can be maintained by performing the next printing after advancing the paper 14 upward by an amount corresponding to the distance of $P-L_2$. On the other hand, in case the distance $L_2$ is so designed as to be $L_2>P$, the predetermined inter-line pitch P can be maintained by performing the next printing after returning the paper 14 toward the lower type belt 4 by an amount corresponding to the distance of $L_2-P$.

The inter-line pitch adjusting pattern shown in FIG. 11 will now be explained. As shown in FIG. 11(*a*), the lower type belt 4 is first selected and printing is performed by a desired number of digits on the paper 14 by using the type belt 4. After the printing of that line is over, the paper is advanced to move the first printed line position 30 up to the confirmable position as shown in FIG. 11(*b*). Since the paper advancing amount in this lower type belt selection is stored beforehand in the ROM 36, the paper advancing operation is performed automatically upon completion of printing of one line.

The inter-line pitch adjustment in response to the selection of the upper type belt 3 or lower type belt 4 for printing at the next line is the same as previously described in connection with FIG. 10, so its explanation is here omitted.

By performing the inter-line pitch adjustment in response to the selected type belt as previously described, there can be obtained a print having uniform inter-line spacings in a very legible state as shown in FIG. 12.

FIGS. 13(*a*) through (*e*) illustrate inter-pitch adjusting patterns in a printer according to a second embodiment of the present invention. This printer is provided with an upper type belt 38, a middle type belt 39 and a lower type belt 40, and a hammer, though not shown, is capable of shifting in three stages—upper, middle and lower stages—in opposed relation to the positions of the belts 38, 39 and 40.

As shown in FIG. 13(*a*), the upper type belt 38 is first selected and printing is performed by a predetermined number of digits by using the type belt 38. After the printing of that line is over, the paper is advanced automatically whereby the first printed line position 30 is moved up to the confirmable position as shown in FIG. 13(*b*).

In case the upper type belt 38 is again selected for printing at the next line, the distance $L_1$ from the first printed line position 30 which occupies the confirmable position to the upper type belt 38 is subtracted from the inter-line pitch P in the control section 33, then the paper 14 is moved upward by an amount based on the result of the calculation, and thereafter printing is performed by using the upper type belt 38 [see FIG. 13(*c*)].

In case the middle type belt 39 is selected, printing is performed by using the type belt 39 in its present position as shown in FIG. 13(*d*) without conducting the paper moving operation because the distance $L_2$ from the first printed line position to the middle type belt 39 is so designed as to be equal to the inter-line pitch P.

In case the lower type belt 40 is selected, the paper 14 is returned toward the lower type belt 40 by an amount corresponding to the distance of $L_3-P$ and then printing is performed by using the lower type belt 40 because the distance $L_3$ from the first printed line position to the lower type belt 40 is longer than the inter-line pitch P.

By so doing, the pitch between the first and second printed line positions 30 and 32 is the same no matter which type belt may be selected.

According to the present invention, constructed as hereinabove described, the inter-line pitch can be adjusted in response to the selection of type belt and there can be obtained a print having a constant inter-line pitch, whose printed state is very legible, thus permitting improvement of the print quality.

What is claimed is:

1. In a multi-stage printer having paper moving means for moving a printing paper along a paper moving direction, a plurality of type belts including at least an upper and a lower type belt spaced apart in successive stages along said paper moving direction, each type belt having a group of types arranged thereon, means for selecting one of said plurality of type belts for printing at a line position, successive line positions being spaced apart by an inter-line pitch on said paper, hammer means for pushing out type from said selected belt to effect a desired printing operation on the paper at a line position in front of the selected belt, hammer moving means for moving said hammer means to a printing position with respect to a selected one of said plurality of type belts, and type belt moving means for moving the types on a selected belt to the printing position to be pushed out by said hammer means for printing selected characters, the improvement comprising control means connected to said paper moving means for advancing the paper to a visually confirmable position above said belts after printing from a first selected one of said belts at a first line position on the paper, and subsequently computing a paper moving amount and moving said paper by said computed paper moving amount for printing from a next selected one of said plurality type of belts at a second line position spaced from the first line position by said inter-line pitch, wherein said computed paper moving amount is the distance from the visually confirmable position to the second line position subtracted from the inter-line pitch, said computed paper moving amount is a variable depending upon which of the plurality of type belts is selected for printing at each of said first and second line positions.

2. A multi-stage printer according to claim 1, further comprising a plurality of inking means, each associated with a respective one of said plurality of belts, for providing an associated one of a plurality of ink colors to each respective belt, so that the type belts can be successively selected to effect printing of lines in different colors.

3. A multi-stage printer according to claim 1, wherein said inter-line pitch is different from the spacing between type belts.

4. A multi-stage printing according to claim 1, wherein said paper moving means and said hammer means are operated by a driving force transmitted through switching means from a single drive source.

5. A multi-stage printer according to claim 1, wherein said hammer means has a hammer pressing means provided with a hammer vertically movably.

6. A multi-stage printer according to claim 5, wherein said hammer is adapted to be moved vertically through an L-shaped lever by energization of an electromagnetic solenoid.

7. A multi-stage printer according to claim 1, wherein said groups of types are provided on endless type belts disposed in two stages, and wherein when printing is performed first by using the upper type belt or the lower type belt, the printed line position is shifted up to said confirmable position by moving said printing paper, and in case printing is to be performed subsequently by using the upper type belt, the printing paper is moved by an amount corresponding to a residual distance of said inter-line pitch, while in case the subsequent printing is to be performed by using the lower type belt, it is performed without moving the printing paper.

8. A multi-stage printer according to claim 1, wherein said groups of types are provided on endless type belts disposed in three stages.

9. A multi-stage printer according to claim 8, wherein the distance from the printing position of the middle-stage type belt up to said confirmable position is equal to said inter-line pitch.

* * * * *